United States Patent [19]

Hamburg

[11] 4,377,143

[45] Mar. 22, 1983

[54] LEAN AIR-FUEL CONTROL USING STOICHIOMETRIC AIR-FUEL SENSORS

[75] Inventor: Douglas R. Hamburg, Birmingham, Mich.

[73] Assignee: Ford Motor Company, Dearborn, Mich.

[21] Appl. No.: 208,764

[22] Filed: Nov. 20, 1980

[51] Int. Cl.[3] ..... F02B 33/00; F02B 3/00

[52] U.S. Cl. ..... 123/440; 123/436; 123/489

[58] Field of Search ..... 123/440, 435, 489, 436

[56] References Cited

U.S. PATENT DOCUMENTS

| | | | |
|---|---|---|---|
| 3,738,341 | 6/1973 | Loos . | |
| 3,855,974 | 12/1974 | Mayer . | |
| 3,899,552 | 8/1975 | Bauer . | |
| 3,916,170 | 10/1975 | Norimatsu et al. . | |
| 3,939,654 | 2/1976 | Creps . | |
| 3,990,411 | 11/1976 | Oberstadt et al. . | |
| 3,998,189 | 12/1976 | Aoki . | |
| 4,023,357 | 5/1977 | Masaki . | |
| 4,027,637 | 6/1977 | Aono . | |
| 4,029,061 | 6/1977 | Asano . | |
| 4,040,394 | 8/1977 | Wahl et al. . | |
| 4,044,234 | 8/1977 | Frobenius et al. . | |
| 4,048,479 | 9/1977 | Rivere . | |
| 4,050,425 | 9/1977 | Hollenboom . | |
| 4,052,968 | 10/1977 | Hattori et al. . | |
| 4,058,978 | 11/1977 | Bockelmann et al. . | |
| 4,064,846 | 12/1977 | Latsch | 123/436 |
| 4,077,364 | 3/1978 | Aoki . | |
| 4,088,100 | 5/1978 | Tokura et al. . | |
| 4,099,491 | 7/1978 | Reddy . | |
| 4,120,270 | 10/1978 | Asano et al. . | |
| 4,222,236 | 9/1980 | Hegedus | 123/435 |
| 4,245,590 | 1/1981 | Grozinger | 123/488 |

*Primary Examiner*—Ronald B. Cox

*Attorney, Agent, or Firm*—Peter Abolins; Clifford L. Sadler

[57] ABSTRACT

This specification discloses an air-fuel ratio control system for an internal combustion engine which can provide air-fuel feedback control at air-fuel ratios lean of stoichiometry while using an air-fuel sensor capable of only indicating stoichiometry. A control means pulses the air-fuel ratio to determine the magnitude of pulse necessary to cross stoichiometry. Thus the air-fuel ratio can be maintained at a desired offset from stoichiometry.

14 Claims, 5 Drawing Figures

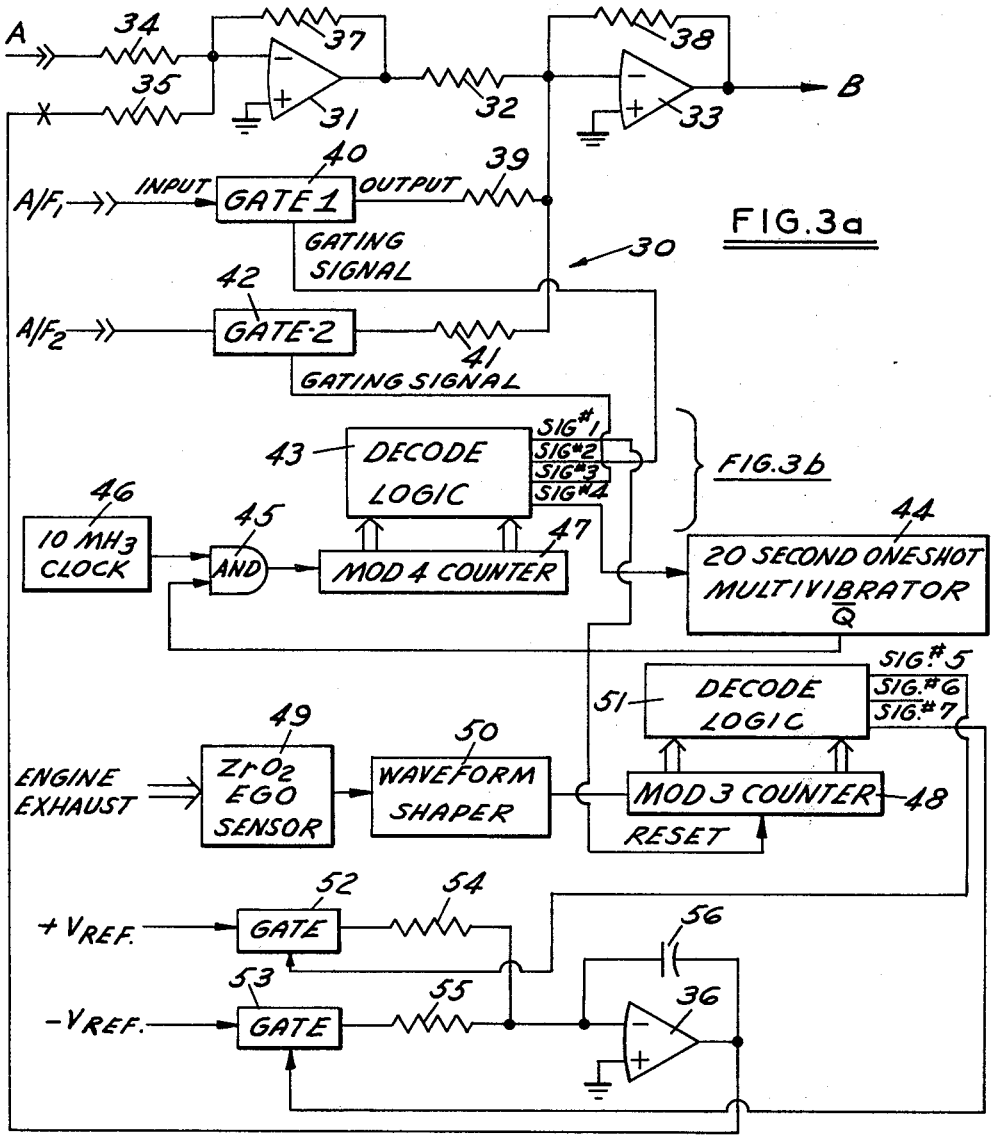
FIG.3b
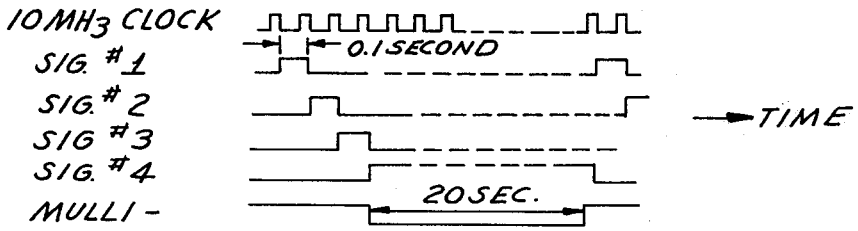

LEAN AIR-FUEL CONTROL USING STOICHIOMETRIC AIR-FUEL SENSORS

BACKGROUND OF THE INVENTION (1 ) Field of the Invention

This invention is concerned with the control of an air-fuel ratio for an internal combustion engine.

(2 ) Prior Art

There are known various ways to control the air-fuel ratio in an internal combustion engine. One reason for such control is that it is possible to reduce the amount of undesirable substances in the exhaust gases of an internal combustion engine by controlling the air-fuel ratio to a figure typically near stoichiometry, which is the ratio containing fuel and oxygen in such proportions that, in perfect combustion, both would be completely consummed. It is well known that the types and amounts of substances present in the engine exhaust are greatly affected by the ratio of air to fuel in the mixture supplied to the engine. Rich mixtures with excess fuel tend to produce higher amounts of hydrocarbons and carbon monoxide. Lean mixtures with small amounts of excess air tend to produce greater amounts of oxides of nitrogen. It is also well known that those gases can be catalytically treated to reduce the amounts of these components, the catalytic treatment including oxidation of carbon monoxide and hydrocarbons and reduction of nitrogen oxides.

A typical sensor such as zirconia can sense the presence of stoichiometry, and the use of such a sensor to maintain the air-fuel ratio at stoichiometry is relatively straight forward. However, recent investigations indicate that there are occasions when it is desirable to operate lean of stoichiometry by a desired amount. It can readily be appreciated that this is a much more difficult task because typical sensors only indicate stoichiometry itself. These are some of the problems this invention overcomes.

SUMMARY OF THE INVENTION

This invention teaches an apparatus and method for maintaining an air-fuel ratio at a desired offset from stoichiometry. This offset of a desired magnitude in a desired direction is achieved using a sensor, such as zirconium dioxide, which senses only stoichiometry. That is, the sensor can detect the direction but not the magnitude of the offset from stoichiometry.

In accordance with an embodiment of this invention, the air-fuel ratio is momentarily pulsed so that it changes by a small amount. If before and after the start of the pulse the sensor has the same reading, the air-fuel ratio before and after the start of the pulse is on the same side (rich or lean) of stoichiometry. If the air-fuel ratio is pulsed twice in the same direction and one of the pulses is larger in magnitude, a change in the output of the two pulses would indicate that stoichiometry is between the two pulse magnitudes. By appropriately changing the magnitude of the pulses, it is possible to determine both the direction and the distance to stoichiometry from the air-fuel ratio. Thus, an air-fuel ratio offset from stoichiometry can be maintained.

For example, assume a first pulse or permutation enriching a base air-fuel ratio results in an indication that the pulsed air-fuel ratio is richer than stoichiometry and a second smaller permutation enriching the base air-fuel ratio indicates that the pulsed air-fuel ratio is lean of stoichiometry. It can be concluded that the separation or offset of the base air-fuel mixture from stoichiometry is an amount between the magnitudes of the two permutations.

FIG. *2a* is a graphical representation of exhaust air-fuel ratio versus time;

FIG. *2b* is a graphical representation of an exhaust gas sensor output with respect to time and correlated to the graph of FIG. *2a;*

FIG. *3a* is a detailed schematic block diagram of one implementation in accordance with an embodiment of this invention; and FIG. *3b* is a graphical representation of the magnitude of the clock signal and signals 1, 2, 3 and 4 indicated on FIG. *3a* with respect to time.

DETAILED DESCRIPTION OF THE INVENTION

Figure 1:
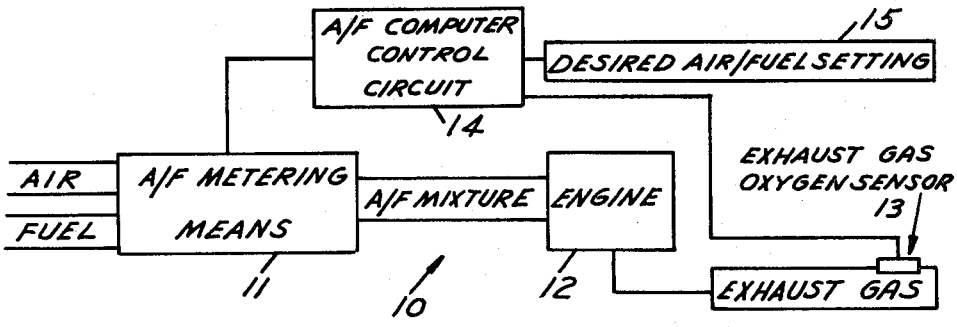
FIG. 1 is a schematic and block diagram of an internal combustion engine with an air-fuel control in accordance with an embodiment of this invention.

Referring to FIG. 1, an air-fuel ratio control means 10 includes an air-fuel metering means 11 which has a first input for receiving air and a second input for receiving fuel. The output of air-fuel metering means 11 supplies an air-fuel mixture to an engine 12. Exhaust gas exiting from engine 12 is detected by an exhaust gas oxygen sensor 13 positioned in the exhaust gas stream. An electrical signal indicative of oxygen content of the exhaust gas is coupled from the exhaust gas oxygen sensor 13 to an air-fuel control circuit 14. A desired air-fuel setting means 15 also supplies an input to air-fuel control circuit 14. The output of air-fuel control circuit 14 is coupled to air-fuel metering means 11 thereby adjusting the air-fuel ratio setting.

A control scheme in accordance with an embodiment of this invention is advantageous for use with a fuel metering system which has a neglible transient variations of air-fuel ratio as a function of air flow changes. Accordingly, air-fuel metering means 11 is advantageously a fuel injection mechanism or a vapor carburetor with a metering venturi. If desired air-fuel control circuit 14 can be part of a larger more complex engine control computer which also accepts inputs such as manifold vacuum pressure, engine revolutions per minute, throttle angle, etc. Exhaust gas oxygen sensor 13 is one capable of providing an electrical output indicative of whether the air-fuel ratio is rich or lean of stoichiometry but not the magnitude of the offset from stoichiometry.

In the lean air-fuel control scheme, control circuit 14 has a memory for storing a desired lean air-fuel ratio versus engine operation conditions required to operate at, or near, the desired lean air-fuel ratio. Such information can be obtained from conventional engine mapping techniques. The control circuit 14 continuously positions the air-fuel metering means 11, such as a pintle in a vapor carburetor, to instantaneously set the air-fuel as dictated by the stored control information for the instantaneous operating conditions. Alternatively, fuel metering means can include a pulse width control for an electronic fuel injection system. The instantaneous, actual air-fuel ratio might not be the desired (i.e., calculated) value due to uncertainties in temperatures, pressures, fuel composition, etc. The air-fuel ratio is checked and corrected in the manner of the following four steps:

1. Under computer control, the air-fuel ratio is momentarily pulsed rich by a value which is computed to be just lean of stoichiometry by an amount Δ air-fuel, ratio (ΔA/F), where ΔA/F is some acceptable error. The duration of the pulse might typically be around 0.1 second. During the pulse duration, the output of a "stoichiometric only" A/F sensor such as zirconium dioxide is sampled.
2. The air-fuel ratio is immediately pulsed rich a second time, but now with a value which is computed to be just rich of stoichiometry by ΔA/F. Again, during the duration of the pulse, the output of the "stoichiometry only" A/F sensor is sampled.
3. If the actual A/F of the engine is equal to the "set" A/F value within ±Δ A/F, then the "stoichiometry only" A/F sensor will yield a "lean level" output in step 1 and a "rich level" output in step 2. Such A/F sensors act as switches and as such either produce only a "lean level" output or a "rich level" output. If the sensor output levels are as indicated above for the two A/F pulsings, no further action is required. Steps 1 and 2 would then be repeated again after a suitable delay period of, say, 20 seconds or longer.
4. If the actual A/F of the engine differs from the "set" A/F value by more than ±Δ A/F, the stoichiometry only A/F sensor will either give "lean level" outputs for both steps 1 and 2, or "rich level" outputs for both steps 1 and 2. In the event that the sensor produces "lean level" outputs for both steps 1 and 2, the computer would make a slowly increasing rich correction of A/F to the actual A/F and would repeat steps 1 and 2 after the aforementioned 20 second delay period. On the other hand, if the A/F sensor produces "rich level" output for both steps 1 and 2, the computer would make a slowly decreasing lean correction to the actual A/F and would repeat steps 1 and 2 after the delay period.

This process described in step 4 would continue until the correct A/F was achieved. The pulsing would then be done periodically with the aforementioned delay period of around 20 seconds, or longer, until a correction in actual A/F once again has to be made. It should be noted that this scheme corrects for long term drifts and assumes that there are no transient A/F errors. The pulsing scheme should not noticeably affect fuel consumption since the pulsing time would only be approximately 1 percent of the total time. The pulsing scheme should not be felt by the driver of the vehicle since the pulse duration (0.1 sec) is too short to cause any measurable change in engine RPM.

Referring to FIG. *2a*, the magnitude of the exhaust air-fuel ratio with respect to time is shown. FIG. *2b* shows the corresponding exhaust gas oxygen sensor output with respect to time. Pulse in the air-fuel ratio occur at times indicated by (a) and (b). With respect to each pair (a) and (b), the magnitude of the pulsed air-fuel ratio at (a) is calculated to be lean of stoichiometry by Δ A/F and the magnitude of the pulsed air-fuel ratio at (b) is calculated to be rich of stoichiometry by Δ A/F. In FIG. *2a*, the horizontal dotted line indicates stoichiometry and air-fuel ratios above it are lean and ratios below it are rich. In FIG. *2b*, the zirconium dioxide sensor output is indicated rich by R at a high level and is indicated lean by L at a low level. The zirconium sensor is sampled at times (a) and (b). The action to be taken for a particular set of outputs at (a) and (b) is tabulated below:

| Condition (a) | Condition (b) | Action to be taken |
|---|---|---|
| No pulse | No pulse | Shift A/F RICHER by ΔA/F, and then recheck |
| No pulse | pulse | No action (Actual A/F is where it is calculated to be) |
| Pulse | pulse | Shift A/F LEANER by ΔA/F, and then recheck |
| pulse | No pulse | Not possible - error someplace |

Referring to FIG. *2a*, the first pair of permutations (a) and (b) show that both are lean of stoichiometry and thus the base air-fuel ratio cannot be determined with respect to offset from stoichiometry. Similarly, the last pair, with respect to time, of permutations (a) and (b) are both rich of stoichiometry and the base exhaust air-fuel ratio cannot be determined. However, the middle pair of permutations (a) and (b) straddle stoichiometry. That is, permutation (a) provides an indication that the pulsed air-fuel ratio is lean of stoichiometry and pulsed permutation (b) provides an indication that the air-fuel ratio is rich of stoichiometry. Accordingly, the magnitude of the base exhaust air-fuel ratio is lean of stoichiometry by an amount between the magnitude of the two pulses at (a) and (b) or, 2 ΔA/F. For illustrative purposes, the base air-fuel shift between the first pair of permutations and the second pair of permutations is exaggerated.

Referring to FIG. 3, a particular implementation of an air-fuel computer control circuit, such as indicated in FIG. 1 by numeral 14, is shown in schematic and block diagram. At an input indicated by A, there is applied a desired air-fuel setting such as that provided by numeral 15 in FIG. 1. For example, the desired air-fuel ratio from a fuel controller can be 20:1. At an output indicated by B, an air-fuel ratio control signal is provided to a fuel system including a fuel metering means such as numeral 11 shown in FIG. 1. An air-fuel ratio computer control circuit 30 includes an inverting summer 31 connected through a resistor 32 to an inverting summer 33. Inverting summer 31 has the negative input connected through a resistor 34 to input (A) and through a resistor 35 connected to the output of an inverting integrator 36. The positive input to inverting summer 31 is grounded. A feedback resistor 37 is connected between resistor 34 and the output of inverting summer 31. Similarly, a feedback resistor 38 is connected between the output of inverting summer 33 and resistor 32. The positive input to inverting summer 33 is connected through a resistor 39 to a gate 40 and a resistor 41 through the output of a gate 42. The input to gate 40 is a first air-fuel ratio value which is calculated such that when it is subtracted from the desired air-fuel ratio, the result will be lean of stoichiometry by a ΔA/F. For example, the air-fuel ratio can be 20.5:1 so that the ΔA/F is equal to +0.5. The input to gate 42 is at a second air-fuel ratio which is calculated such that when it is subtracted from the desired air-fuel ratio the result will be rich of stoichiometry by a ΔA/F. For example, the second air-fuel ratio can be equal to 19.5:1 so that the ΔA/F is equal to −0.5. A decoder logic 43 supplies a signal number 2 which is used as a gating signal coupled to gate 40. Decoder logic 43 also supplies a signal 3 which is used as a gating signal to gate 42. An output signal 4 from decoder logic 43 is applied to a 20 second one shot multivibrator 44 which is coupled to a logic AND circuit 45. The other input to the logic AND circuit 45 is provided by a 10 MHz clock 46. The output of the logic AND circuit 45 is coupled to a modulus 4 counter 47 which has an output coupled to decode logic 43. The output of the 20 second one-shot multivibrator 44 at $\bar{Q}$ is zero for 20 seconds thus inhibiting any air-fuel ratio pulsing. Decode logic 43 also has an output signal number 1 which is coupled to the reset input of a modulus 3 counter 48. Modulus 3 counter 48 receives an input from a zirconium dioxide exhaust gas oxygen sensor 49 through a waveform shaper 50. The output of modulus 3 counter 48 is coupled to a decode logic 51 which has output signals 5, 6 and 7. Output signal 5 is applied to a gate 52 as a gating signal. Output signal 7 is applied to a gate 53 as a gating signal. A positive reference voltage applied to gate 52 and a negative reference voltage is applied to gate 53. The positive and negative reference voltages are chosen along with resistor and capacitive values to make a shift $\Delta A/F$ during the 20 second inhibited, or dead, period produced by 20 second one-shot multivibrator 44. The output of gate 52 is coupled through a resistor 54 to the negative input of inverting integrator 36. The output of gate 53 is coupled through a resistor 55 to the same negative input of inverting integrator 36. A capacitor 56 is coupled between the output of inverting integrator 36 and the negative input of inverting integrator 36. The positive input of inverting integrator is grounded.

In operation, output signal 5 of decode logic 51 can have a high state which signifies that there were no air-fuel ratio crossing of stoichiometry due to the air-fuel ratio pulsing. This means that the air-fuel ratio is too lean and requires a rich correction from the integrator 36. If output signal 6 has a high state, that means that one air-fuel ratio pulse crosses the stoichiometry line (corresponding to the second set of (a) and (b) pulses shown in FIG. 2*a*.). This is what should occur if the actual air-fuel ratio is equal to the desired air-fuel ratio within the tolerance of $\pm\Delta A/F$. No correction is required in such a situation. Accordingly, output signal 6 is shown but is not connected. If output signal 7 has a high state, this means that there are two crossings of the stoichiometry air-fuel ratio by the air-fuel ratio pulses. This means that the air-fuel ratio is too rich and requires a lean correction from integrator 36.

When correction is required, the output of inverting integrator 36 supplies a signal to the negative input of inverter summer 31. Referring to FIG. 3*b*, the output signals of decode logic 43, signals 1, 2, 3 and 4 are shown with respect to time. Also, at the top of FIG. 3*b* is shown the ten MHz clock provided by clock 46 and at the bottom of FIG. 3*b* is the output of multivibrator 44 which is initiated by signal 4 from decode logic 43. Signals 1, 2 and 3 are 0.1 second pulses which follow sequentially and establish the duration and spacing of the pairs of pulses shown in FIG. 2*a*.

Figure 2:
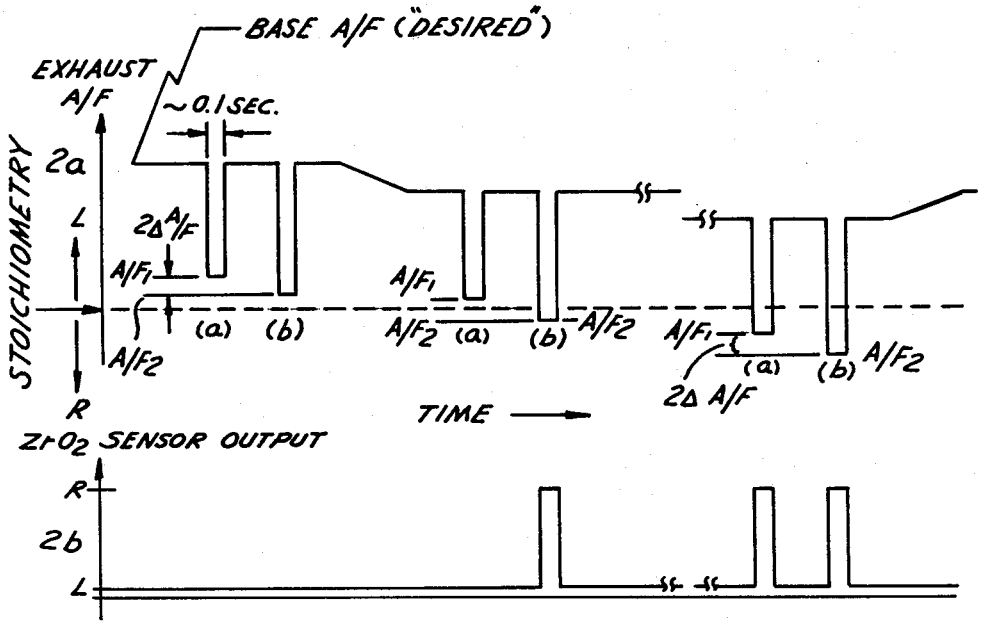

In view of the above, it can be appreciated that the circuitry of FIG. 3*a* provides the pulses shown in FIG. 2*a*. The upper trace of the air-fuel ratio line indicates the desired or base air-fuel ratio, while the bottoms of the pulses are then calculated air-fuel ratio values. That is, the pulse occurring at (a) in FIG. 2*a* is designated as $A/F_1$, the input to gate 40, and the air-fuel ratio at the bottom of the pulse occurring at time (b) is designated as $A/F_2$, the input to gate 42. Thus, signal 5 would indicate the situation corresponding to the first pairs of pulses in FIG. 2*a*, signal 6 would indicate the situation corresponding to the second two pairs of pulses in FIG. 2*a* and signal 7 would indicate the situation corresponding to the final and third pair of pulses in FIG. 2*a*.

Waveform shaper 50 is used to eliminate multiple crossing near stoichiometry such as may be caused by noise. Thus, during an air-fuel ratio pulse or perturbation the pulse can only indicate one crossing of the stoichiometry air-fuel ratio magnitude. This is true even if there may be multiple crossings of the stoichiometry line during the pulse because of noise.

Various modifications and variations will no doubt occur to those skilled in the various arts to which this invention pertains. For example, the particular fuel metering mechanism may be varied from that described herein. Further, if it is desired to operate rich of stoichiometry, the previous discussion applies with the inversion of lean and rich. These and all other variations which basically rely on the teachings through which this disclosure has advanced the art are properly considered within the scope of this invention.

I claim:

1. An air-fuel ratio control means for an internal combustion engine, said air-fuel ratio control means including:

stoichiometric sensing means for providing an output in response to a stoichiometric condition so that it can be determined whether an air-fuel ratio is rich or lean of stoichiometry;

reference means for providing a desired air-fuel ratio;

fuel metering means which is electronically controllable for injecting a given amount of fuel; and adjustment means for pulsing a base air-fuel ratio, comparing the resulting perturbed air-fuel ratio with a stoichiometric ratio, and for changing the base air-fuel ratio so that the next perturbation produces less of a change from stoichiometry thus permitting the base air-fuel ratio to be maintained at an offset from stoichiometry.

2. An air-fuel ratio control means as recited in claim 1 wherein said adjustment means includes logic means for selecting a first magnitude air-fuel permutation wherein the perturbed air-fuel ratio is positioned on the lean side of stoichiometry and for selecting a second magnitude air-fuel permutation wherein the perturbed air-fuel ratio is positioned on the rich side of stoichiometry.

3. An air-fuel ratio control means as recited in claim 2 wherein said adjustment means includes a clock means for periodically activating said logic means thereby initiating the permutations in the magnitude of the air-fuel ratio.

4. An air-fuel ratio control means as recited in claim 3 wherein said adjustment means includes a first gating means for establishing a difference in air-fuel ratio magnitude between two air-fuel ratio pulses.

5. An air-fuel ratio control means as recited in claim 4 wherein said adjustment means includes a second gating means for applying a first calculated air-fuel ratio which determines the air-fuel ratio magnitude during a first air-fuel ratio pulse and for applying a second calculated air-fuel ratio which determines the air-fuel ratio magnitude during a second air-fuel ratio pulse, the first air-fuel ratio value being such that when it is subtracted from the desired air-fuel ratio magnitude the result will be lean of stoichiometry and the second air-fuel ratio value being such that when it is subtracted from the desired air-fuel ratio magnitude the result will be rich of stoichiometry.

6. An air-fuel ratio control means as recited in claim 5 wherein said adjustment means includes:

an output means for producing a first output when two air-fuel ratio magnitude pulses do not cross a stoichiometric air-fuel ratio magnitude and for producing a second output when two air fuel ratio magnitude pulses both across a stoichiometric air-fuel ratio magnitude.

7. An air-fuel ratio control means as recited in claim 6 wherein said adjustment means includes pulse air-fuel magnitude varying means receiving an input from said output means for causing an increase in the richness of the pulse air-fuel ratio magnitude in response to said first output and for causing a decrease in the richness of the pulse air-fuel ratio magnitude in response to said second output.

8. An air-fuel ratio control means for an internal combustion engine, said air-fuel ratio control means including:

stoichiometric sensing means for providing an output in response to a stoichiometric condition so that it can be determined whether a sensed air-fuel ratio is rich or lean of stoichiometry;

reference means for providing a desired air-fuel ratio;

fuel metering means for injecting fuel into the internal combustion engine;

adjustment means coupled to said stoichiometric sensing means, said reference means, and said fuel metering means for establishing a base air-fuel ratio, pulsing the air-fuel ratio at least two unequal pulses to determine the offset, within a braketed error, of the base air-fuel ratio from a stoichiometric air-fuel ratio, and adjusting the base air-fuel ratio toward the desired air-fuel ratio of the offset of the base air-fuel from the stoichiometric air-fuel ratio is not the same as the offset of the desired air-fuel ratio from the stoichiometric air-fuel ratio, said adjustment means including:

a first gating means for establishing a difference in air-fuel ratio magnitude between two air-fuel ratio pulses;

a second gating means for applying a first calculated air-fuel ratio which determines the air-fuel ratio magnitude during a first air-fuel ratio pulse and for applying a second calculated air-fuel ratio which determines the air-fuel ratio magnitude during a second air-fuel ratio pulse, the first air-fuel ratio value being such that when it is subtracted from the desired air-fuel ratio magnitude the resulting air-fuel ratio will be lean of stoichiometric air-fuel ratio and the second air-fuel ratio value being such that when it is subtracted from the desired air-fuel ratio magnitude the resulting air-fuel ratio will be rich of a stoichiometric air-fuel ratio;

a clock means for periodically activating said second gating means;

an output means for producing a first output when the two air-fuel ratio magnitude pulses do not cross a stoichiometric air-fuel ratio magnitude and for producing a second output when the two air-fuel ratio magnitude pulses both cross a stoichiometric air-fuel ratio magnitude; and offset means receiving an input from said output means and coupled to said fuel metering means for causing an increase in the richness of the base air-fuel ratio magnitude in response to said first output and for causing a decrease in the richness of the base air-fuel ratio magnitude in response to said second output.

9. A method for controlling the air-fuel ratio for an internal combustion engine including the steps of:

sensing the base air-fuel ratio of the exhaust gas of the internal combustion engine;

pulsing the base air-fuel ratio to increase the richness to the air-fuel ratio;

sensing the value of the pulsed air-fuel mixture with respect to a stoichiometric air-fuel mixture; and adjusting the base air-fuel mixture so that if both the stored base and the pulsed air-fuel mixture values are lean of stoichiometry, the air-fuel mixture is made richer, if both the stored base and the pulsed air-fuel mixture values are rich of stoichiometry the air-fuel mixture is made leaner, if the stored and the pulsed value of the air-fuel mixture are on opposite sides of stoichiometry then no change is made in the air-fuel mixture.

10. A method as recited in claim 9 wherein the step of pulsing the air-fuel mixture includes the steps of;

varying the magnitude of the pulse; and varying the direction of the pulse so that the desired operating point of the air-fuel mixture can be relatively accurately positioned between the stored value and the pulsed value of air-fuel mixture.

11. A method as recited in claim 10 wherein the step of varying the magnitude of the pulse includes the step of:

increasing the richness of the base air-fuel mixture;

applying an air-fuel ratio pulse to the base air-fuel mixture; and sensing to see if there is a change in the output of a stoichiometry only sensor from before the application of the pulse and during the application of the pulse.

12. A method as recited in claim 11 further comprising the step of varying the magnitude of the air-fuel ratio of two adjacent pulses to a predetermined difference by the application of a positive and negative reference voltage.

13. A method as recited in claim 12 further comprising the steps of producing a first output when two air-fuel ratio pulses do not cross a stoichiometric air-fuel ratio magnitude; and producing a second output when two air-fuel ratio magnitude pulses both cross a stoichiometric air-fuel ratio magnitude.

14. A method as recited in claim 13 further comprising the steps of:

adjusting the pulsed air-fuel magnitude by increasing the richness of the pulsed air-fuel ratio magnitude in response to the first output; and adjusting the pulsed air-fuel magnitude to decrease the richness of the pulsed air-fuel ratio magnitude in response to said second output.

* * * * *